United States Patent [19]

Tatin

[11] Patent Number: 4,619,663

[45] Date of Patent: Oct. 28, 1986

[54] PROCESS FOR THE BLEACHING OF TEXTILES AND STABILIZING COMPOSITION THEREFOR

[75] Inventor: Gerard Tatin, Mulhouse, France

[73] Assignee: Atochem, France

[21] Appl. No.: 603,708

[22] Filed: Apr. 25, 1984

[30] Foreign Application Priority Data

May 10, 1983 [FR] France ..... 83 07766

[51] Int. Cl.[4] ..... D06L 3/00

[52] U.S. Cl. ..... 8/107; 252/99; 252/186.3; 252/186.31

[58] Field of Search ..... 8/107; 252/186.3, 186.31, 252/99

[56] References Cited

U.S. PATENT DOCUMENTS

| | | | |
|---|---|---|---|
| 3,640,885 | 2/1972 | Rhees et al. | 252/186 |
| 3,661,789 | 5/1972 | Corey et al. | 252/186 |
| 3,919,102 | 11/1975 | Kühling et al. | 252/99 |
| 4,107,065 | 8/1978 | Gray | 252/99 |
| 4,120,811 | 10/1978 | Yagi et al. | 252/186 |
| 4,195,974 | 4/1980 | Kothe et al. | 8/138 |
| 4,230,591 | 10/1980 | Finley et al. | 252/102 |
| 4,450,089 | 5/1984 | Broze et al. | 252/95 |

FOREIGN PATENT DOCUMENTS

| | | |
|---|---|---|
| 784538 | 10/1957 | United Kingdom . |
| 1385885 | 3/1975 | United Kingdom . |

*Primary Examiner*—Paul Lieberman
*Assistant Examiner*—Willie J. Thompson
*Attorney, Agent, or Firm*—Sigalos & Levine

[57] ABSTRACT

A stabilizing composition for and a process for the bleaching of cellulose-containing fibers or fabrics in a bleaching bath containing an oxidizing agent without any degradation thereof due to the presence of iron or ferrous metals, comprising adding to said bath a stabilizing composition consisting essentially of:

| | |
|---|---|
| A metal chelating agent | 1–2 g/l of bath |
| Sodium metasilicate pentahydrate | 0–8 g/l of bath |
| Sodium tetraborate decahydrate | 5–10 g/l of bath |
| A soluble alkaline phosphate | 10–15 g/l of bath (calculated in weight of anhydrous product) |
| A non-ionic wetting agent | 1–2 g/l of bath |

5 Claims, No Drawings

PROCESS FOR THE BLEACHING OF TEXTILES AND STABILIZING COMPOSITION THEREFOR

BACKGROUND OF THE INVENTION

The present invention concerns a process for the bleaching of cellulosic or cellulosic/synthetic fibers and fabrics by means of oxidizing agents such as hydrogen peroxide, persalts and sodium peroxide in the presence of particles of iron or of ferrous metals and a stability composition therefor.

The presence of metallic particles on fabrics during the course of bleaching is due to numerous factors: remains of hoop-irons rusted onto the bales of cotton, sharpening of carding brushes during spinning, use of iron vats for the preparation of sizing, abrasion of combs during the course of weaving, rust of pipes transported by the water used for washings and bleaching baths and the like.

The mechanism of fiber degradation in the presence of particles of iron or of ferrous metals during the course of bleaching by oxidation is well known and long been a concern.

The metallic particles catalyze the decomposition of the oxidizing agent used for bleaching, causing an alteration of the fibers by the formation of oxycellulose. These alterations are localized at the sites where the catalyst adheres to the fiber. They manifest themselves by the formation of holes having the form of points or of streaks, while the remainder of the fabric can be absolutely faultless.

Also, when the alteration is less pronounced, there is the formation of spots during dyeing, with the coloring agent having a different affinity for the cellulose and the oxycellulose. These phenomena have been abundantly described in the literature; notably in:

Technologie Chimico-textile. Blanchimentteinture. Impression en Apprêts 1st volume by Gustave CAPRON.

Textile Chemistry—Impurities in fibers. Purification of fibers by R. H. PETERS—Vol. II, p. 11 (1969).

The principles of bleaching and finishing of cotton—3rd edition by S. R. TROTMAN M.A. Fic. p. 510 (1927).

Acitvators and stabilizers for peroxide bleaching. (in German). Text. Prax. Int. 29 (1974) by Dr. P. NEY p. 1552–1565.

The degradations occasioned by the presence of particles of iron or of ferrous metals during the course of bleaching textile fabrics thus translate into an irreversible degradation of the fibers and because of this fact lead to important losses for the bleaching enterprises.

Since, as has been shown further above, the origins of these particles are numerous, the problems posed by the latter are of a serious nature.

Consequently, there exists an industrial need responding to a constant worry of the profession of textile embellishing, to have a suitable process at their disposal.

A solution utilized in the prior art consisted of carrying out a an alkaline treatment of the fabric in the hot state. This operation which is situated between sizing removal and bleaching cannot be carried out in the case of a simultaneous desizing/bleaching operation. Furthermore, this treatment consumes energy and its effectiveness can be limited since the water which is used in the later rinsing operation can contain traces of iron in the form of rust.

SUMMARY OF THE INVENTION

The present invention overcomes these faults and provides an economical process making it possible to bleach textile fibers and fabrics without any degradation, in the presence of particles of iron and of ferrous metals.

Briefly stated, the present invention comprises the process of bleaching a cellulosic fiber or fabric in a bleaching bath containing an oxidizing agent and a stabilizing composition consisting essentially of:

| | Proportion |
|---|---|
| A metal chelating agent | 1 to 2 g/l of bath |
| Sodium metasilicate pentahydrate | 0 to 8 g/l of bath |
| Sodium tetraborate decahydrate | 5 to 10 g/l of bath |
| Soluble alkaline phosphate | 10 to 15 g/l of bath (calculated in weight of anhydrous compound) |
| Non-ionic wetting agent | 1 to 2 g/l of bath |

The invention also comprises said stabilizing composition.

DETAILED DESCRIPTION

The bleaching bath can be any conventionally used and the oxidizing agent of the bleaching bath can, for instance, be selected from among hydrogen peroxide, persalts, and sodium peroxide.

While any conventional metal chelating agent can be used, it is preferred to use ethylenediamine tetraacetic acid. In like manner, the preferred soluble alkaline phosphate is disodium phosphate. Any conventional non-ionic surfactant can be used, such as UKANIL 1036N made by ATOCHEM.

Taking into account the present state of the bleaching art, the present invention presents a surprising characteristic. In fact, Belgian Pat. No. 789,699 by LAPORTE, concerning bleaching compositions based on hydrogen peroxide indicates that the baths are less effective when disodium phosphate is added to them. There was thus an adverse, preconceived opinion to be conquered in order to carry out the present invention and to find that a soluble alkali phosphate would not be detrimental.

The process of the invention makes it possible to bleach fibers and fabrics made of cellulosic fibers or mixed cellulose/synthetic fibers without any degradation in the presence of particles of iron and of ferrous compounds such as rust.

The process of the invention furthermore makes it possible to carry out the desizing/bleaching simultaneously in the presence of amylase.

The invention will be described in connection with the following examples which are set forth for purposes of illustration only.

The examples of the invention have been prepared according to the following technique:

(a) Random distribution of metallic particles in the unbleached fabrics (this distribution was brought about by means of an acid solution of sodium thiocyanate). The phenomenon was standardized for all the examples by introducing a rusty pin into each sample of unbleached fabric;

(b) Impregnation of the unbleached fabric in the blecing bath or desizing/bleaching bath and then squeezing the fabric in order to leave in the fabric only the quantity of bath required for the reaction (this quantity has been fixed at 100% by weight of dry fabric);

(c) steaming the fabric in order to raise the temperature thereof to the desired temperature of about 30°-35° C.

(d) Deposition by rolling up the fabric or placing it into folds for 30 minutes at the noted temperature; and (e) Washing of the fabric at 90°-95° C.; then at 60° C.; and lastly in cold water.

EXAMPLES 1 to 3

To one liter of impregnation bath containing 40 ml of 35% $H_2O_2$ there was added a stabilizing composition consisting of:

| | |
|---|---|
| EDTA | 1.0 g |
| Sodium metasilicate pentahydrate | 7.5 g |
| Sodium tetraborate decahydrate | 10.0 g |
| Anhydrous disodium phosphate | 15.0 g |
| Non-ionic wetting agent ("UKANIL" 1036N) | 1.5 g |

The bath also contained 10 g of amylase ("Enzylase" C of DIAMALT Company).

Three different fabrics, as noted below, were treated with this bath and the results are set forth in table that follows the description of such fabrics.

| | |
|---|---|
| Example 1: | Twill fabric of 240 g/m$^2$. European standard - German origin. 8% starch sizing in weight of the fabric. |
| Example 2: | Cotton cloth (calico) fabric of 160 g/m$^2$. Chinese origin. 6% starch sizing in weight of the fabric. |
| Example 3: | Cotton cloth (calico) fabric of 180 g/m$^2$. Very brownish colored - Tunisian origin. 5% starch sizing in weight of fabric. |

| Example | White in ° ELREPHO | Residual Starch % | Hydrophilicity (Absorbency) | DP* |
|---|---|---|---|---|
| 1 | 81.7 | 0 | instantaneous | 1860 |
| 2 | 83.7 | 0 | instantaneous | 1900 |
| 3 | 82 | 0 | instantaneous | 1720 |

*DP: Degree of polymerization measured at the point of impact of the pins.

There were no rust spots or abnormal lowering of the DP for any of the fabrics tested.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

What is claimed is:

1. A process for the bleaching of cellulose-containing fibers or fabrics in a bleaching bath containing an oxidizing agent comprising adding to said bath a stabilizing composition consisting essentially of:

| | |
|---|---|
| A metal chelating agent | 1-2 g/l of bath |
| Sodium metalsilicate pentahydrate | 0-8 g/l of bath |
| Sodium tetraborate decahydrate | 5-10 g/l of bath |
| A soluble alkali phosphate | 10-15 g/l of bath (calculated in weight of anhydrous product) |
| A non-ionic wetting agent | 1-2 g/l of bath |

2. The process of claim 1, in which said oxidizing agent is selected from hydrogen peroxide, persalts, or sodium peroxide.

3. The process of claim 1 or 2, in which said metal chelating agent is ethylene diamine tetraacetic acid and said soluble alkali phosphate is disodium phosphate.

4. A stabilizing composition for addition to an oxidizing agent containing bleaching bath for cellulose-containing textile fiber or fabric consisting essentially of:

| | |
|---|---|
| A metal chelating agent | 1-2 g/l of bath |
| Sodium metalsilicate pentahydrate | 0-8 g/l of bath |
| Sodium tetraborate decahydrate | 5-10 g/l of bath |
| A soluble alkali phosphate | 10-15 g/l of bath (calculated in weight of anhydrous product) |
| A non-ionic wetting agent | 1-2 g/l of bath |

5. The stabilizing composition of claim 4, wherein the metal chelating agent is ethylenediamine tetraacetic acid and the soluble alkali phosphate is disodium phosphate.

* * * * *